US009554660B2

(12) United States Patent
Chubb et al.

(10) Patent No.: US 9,554,660 B2
(45) Date of Patent: Jan. 31, 2017

(54) REACH-IN DOOR FOR REFRIGERATED CABINETS

(75) Inventors: Richard A. Chubb, Voorhees, NJ (US); Ralph R. Wearsch, Huntersville, NC (US)

(73) Assignee: THERMOSEAL INDUSTRIES, LLC, Gloucester City, NJ (US)

( * ) Notice: Subject to any disclaimer, the term of this patent is extended or adjusted under 35 U.S.C. 154(b) by 1012 days.

(21) Appl. No.: 12/806,749

(22) Filed: Aug. 19, 2010

(65) Prior Publication Data

US 2011/0043089 A1 Feb. 24, 2011

Related U.S. Application Data

(60) Provisional application No. 61/274,611, filed on Aug. 19, 2009.

(51) Int. Cl.

| | |
|---|---|
| ***A47F 3/00*** | (2006.01) |
| ***A47F 3/04*** | (2006.01) |
| ***E05D 5/02*** | (2006.01) |
| ***E05F 1/12*** | (2006.01) |
| ***E05D 7/081*** | (2006.01) |
| *E05F 3/20* | (2006.01) |

(52) U.S. Cl.

CPC ..... *A47F 3/0434* (2013.01); *E05D 5/0238* (2013.01); *E05D 7/081* (2013.01); *E05F 1/1207* (2013.01); *E05F 3/20* (2013.01); *E05Y 2900/202* (2013.01)

(58) Field of Classification Search

USPC ..... 312/116, 401, 405, 138.1, 324; 62/249, 62/248, 246; 49/501, 402; 52/786.1, 786.13; 428/34

See application file for complete search history.

(56) References Cited

U.S. PATENT DOCUMENTS

| | | | | | |
|---|---|---|---|---|---|
| 3,114,944 | A | * | 12/1963 | Horgan, Jr. | 49/424 |
| 3,499,245 | A | * | 3/1970 | Richter et al. | 49/70 |
| 3,629,972 | A | * | 12/1971 | Rehberg et al. | 49/240 |
| 3,949,526 | A | * | 4/1976 | Sherlock et al. | 49/501 |
| 3,965,638 | A | * | 6/1976 | Newman | 52/786.13 |
| 4,226,489 | A | * | 10/1980 | Haag | 312/296 |
| 4,330,310 | A | * | 5/1982 | Tate et al. | 62/275 |
| 4,741,127 | A | * | 5/1988 | Bockwinkel | 49/501 |
| 4,753,043 | A | * | 6/1988 | Bockwinkel | 49/501 |
| 4,831,780 | A | * | 5/1989 | Bockwinkel | 49/504 |
| 5,255,473 | A | * | 10/1993 | Kaspar et al. | 49/501 |
| 5,975,664 | A | * | 11/1999 | Banicevic et al. | 312/405 |
| 6,148,563 | A | * | 11/2000 | Roche et al. | 49/501 |
| 6,406,108 | B1 | * | 6/2002 | Upton et al. | 312/116 |
| 6,637,093 | B2 | * | 10/2003 | Richardson et al. | 29/458 |
| 6,655,766 | B2 | * | 12/2003 | Hodges | 312/406.2 |
| 7,043,886 | B1 | * | 5/2006 | Chubb | 52/656.4 |
| 2006/0260229 | A1 | * | 11/2006 | McKinlay et al. | 52/204.593 |

* cited by examiner

*Primary Examiner* — Daniel Rohrhoff
(74) *Attorney, Agent, or Firm* — Francis C. Hand; Carella, Byrne, et al

(57) ABSTRACT

A door is constructed for a refrigerated cabinet and includes an insulated glass IG unit of rectangular shape and a frame surrounding the unit. The frame is formed of a pair of horizontally disposed aluminum rails and a pair of vertically disposed plastic stiles. Each stile is secured at each end to a respective end of each of the rails by screws. Each rail and stile receives the insulated glass unit in a recessed manner. Full perimeter gasketing of the door is obtained by a vertical gasket on the stile on the hinged side of the door and a pair of horizontal seals on the cabinet opposite the rails of the door.

9 Claims, 5 Drawing Sheets

FIG. 6
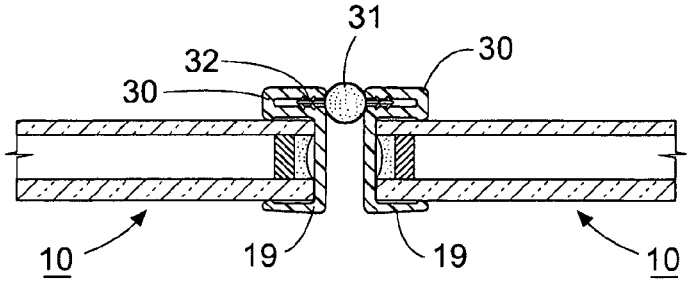
FIG. 7
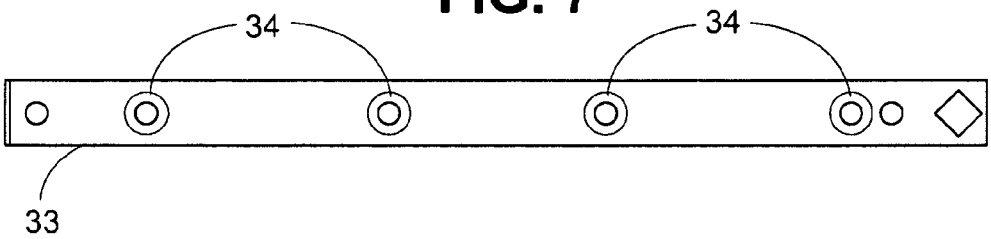
FIG. 8
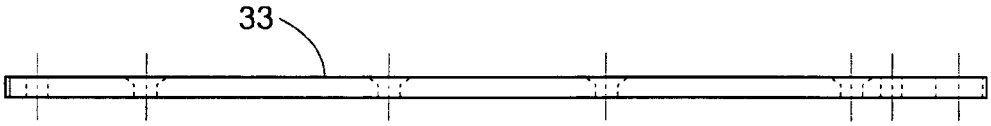
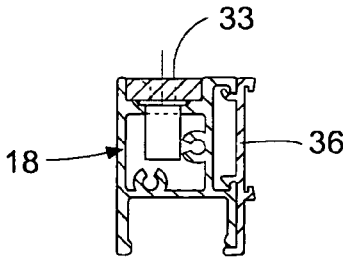
FIG. 9

REACH-IN DOOR FOR REFRIGERATED CABINETS

This application claims the benefit of Provisional Patent Application 61/274,611 filed Aug. 19, 2009.

This invention relates to a reach-in door for refrigerated cabinets.

As is known various types of doors have been provided for mounting on refrigerated cabinets. In some cases, the doors have been provided with glass units over a substantial portion of the front of the doors to permit easy viewing of the contents of the cabinets. For example, U.S. Pat. No. 7,043,886 provides a door assembly for commercial refrigerators and freezers that includes an insulated glass unit made up of two or more glass panes maintained in spaced-apart relation by tubular spacers with the interior between the panes appropriately sealed.

Because insulated glass doors are relatively heavy and require a sturdy and rigid frame for supporting their weight and for withstanding abusive repeated openings and closings that occurs in commercial establishments, the glass unit is supported within a relatively rigid outer metallic frame, commonly formed from aluminum extrusions, with the metal frame overlapping the periphery of the glass unit for retaining the glass unit in position and for providing a decorative finished appearances to the door assembly. While improvements in energy efficiencies, structural rigidity, and mounting of such door assemblies have taken place over the years, such insulated glass door assemblies have remained substantially unchanged.

U.S. Pat. No. 6,148,563 describes a reach-in door having a finished molded door frame of a suitable material, such as a reaction injection molded polyurethane, that does not require a metal frame or covering of any type.

Other types of reach-in doors use heavy, bulky structural extrusions to accomplish a full-perimeter door framing system—these are typically aluminum (for strength), coupled with heavy PVC breakers to attempt to isolate the aluminum from the cold interior air inside the refrigerator—they often use perimeter heater wires inside the doors to prevent external condensation.

Accordingly, it is an object of the invention to provide a state-of-the-art, energy-efficient, higher-product-visibility, lightweight, low-cost, easy-to-install, modular, frameless reach-in door for commercial refrigerator applications.

It is another object of the invention to provide an improved product viewing through a reach-in door for commercial refrigerator applications.

It is another object of the invention to improve energy efficiency and meet California and U.S. Energy Standards for commercial refrigeration display cases in grocery stores and convenience stores across North and South America, and worldwide, as applicable.

It is another object of the invention to eliminate the traditional, expensive, complicated, separate frame and mullion system/structure for mounting and gasketing swing doors to the face of a reach-in refrigerator cabinet.

It is another object of the invention to eliminate the substantial freight investment associated with shipping bulky, low-weight, low-density door frame systems that are separate from the doors for commercial refrigerator applications.

Briefly, the invention provides a door for a refrigerated cabinet comprising an insulated glass unit of rectangular shape and a frame surrounding the insulated glass unit. The reach-in door is particularly constructed as a medium temperature all glass door for use in commercial OEM food display refrigeration products for sale to the supermarket, convenience store, and dollar store industries.

The insulated glass (IG) unit has at least a pair of glass panes and a perimeter spacer system maintaining the glass panes in parallel spaced apart relation. This unit is sealed about the entire periphery and can be manipulated as a modular unit when assembling the door.

Where the door is to be heated, the IG unit may also include a transparent electrically conductive heating film bonded to at least one of the panes and a pair of electrically conductive bus bars mounted in electrical contact on the heating film on opposite sides of the pane. A spring clip corner key, such as described in U.S. Ser. No. 12/798,806, filed Apr. 12, 2010, may also be provided to deliver electrical energy to the bus bars.

The frame includes a pair of horizontally disposed aluminum rails and a pair of vertically disposed plastic stiles, each of which is secured at each end thereof to a respective end of each of the rails. The individual parts of the frame, i.e. the rails and stiles, are each secured to the insulated glass unit in separate operations in a step-wise manner. That is, one rail is secured to the IG unit to function as the bottom rail, each stile is then secured to the respective sides of the IG unit and then the second rail is secured to the remaining side of the IG unit to function as the top rail. The ends of the rails and stiles are secured together as by screws to form an integrated frame about the IG unit.

Each aluminum rail is formed, as by extrusion, to have four walls defining a central hollow box, a first pair of walls outstanding from the box to define a first channel for receiving the IG glass unit in a recessed manner, a second pair of walls outstanding from the box to define a second channel with an inturned lip on each wall for receiving a breaker plate, and a third pair of walls to define a recess for receiving a hinge plate.

Each plastic stile is formed, as by extrusion, to have a pair of walls defining a channel for receiving the IG unit in a recessed manner and an L-shaped leg integrally formed on an outside of one of the walls to define a recess for receiving a foam gasket.

In order to facilitate securement of the rails and stiles into an integrated frame about the IG unit, each aluminum rail is provided with a pair of integrally formed C-shaped ears within the box and at each end thereof while each stile is provided with a pair of recessed bores at each end thereof aligned with the respective C-shaped ears of a respective rail. During assembly of the door, screws are passed through the bores of the stiles and into the C-shaped ears of the rails to secure the stiles to the rails.

The reach-in door is particularly constructed for use on a refrigerated cabinet along with a plurality of such doors mounted on the cabinet in side-by-side relation for movement between a closed position relative to the cabinet and an open position relative to the cabinet.

The L-shaped leg of the stile that carries the gasket as well as the gasket are suitably positioned and sized so that the gasket extends over the height of the stile for sealing against the stile of an adjacent door when in the closed position. Upon opening of the door, the gasket is moved into the cabinet.

The breaker plates that are mounted on the top rail and the bottom rail are each formed with a channel which receives a steel strips. In addition, a pair of horizontally disposed seals is secured to the cabinet opposite each door for sealing contact with a steel strip in the breaker plate of a rail in the closed position of the door. The two horizontally disposed seals on the cabinet at each door and the vertical gasket between two adjacent doors provides sealing (i.e. gasketing) of a door on four sides, i.e. top, bottom and two vertical sides.

These and other objects and advantages of the invention will become more apparent from the following detailed description taken in conjunction with the drawings wherein:

FIG. 6 illustrates a partial top view of two adjacent doors in accordance with the invention with a foam gasket mounted in a vertical plastic stile of one door and a pocket filler mounted in a vertical plastic stile of the other door;

FIG. 7 illustrates a view of a hinge plate of the door;

FIG. 8 illustrates a side view of the hinge plate of FIG. 7;

FIG. 9 illustrates a cross-sectional view of a metal rail with a hinge plate in place;

Figure 1:
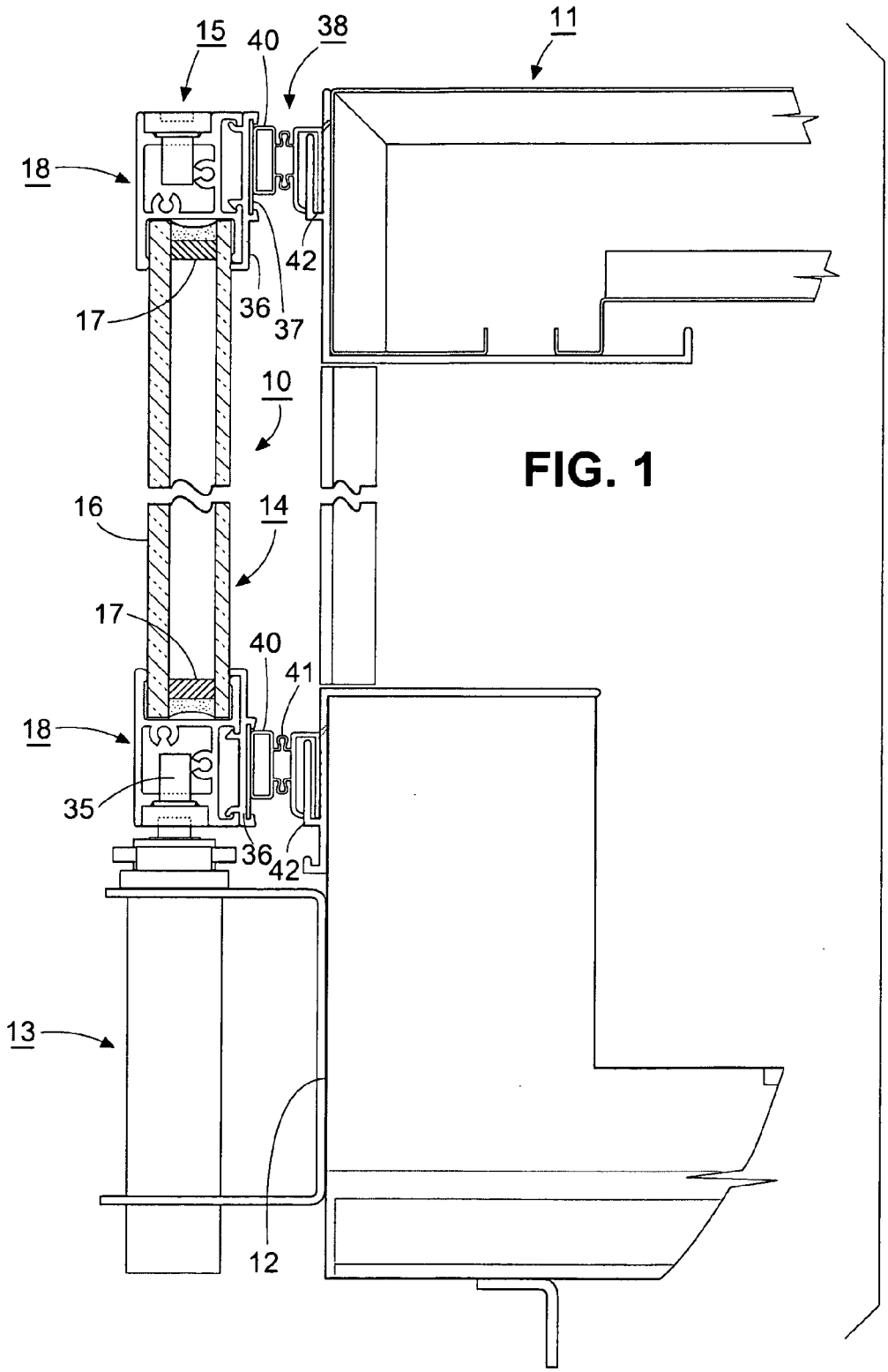
FIG. 1 illustrates a cross-sectional view of the reach-in door according to the invention hingedly mounted on a refrigerated cabinet of conventional construction.

Referring to FIG. 1, the reach-in door 10 is particularly constructed to be mounted in hinged fashion to the front of a refrigerated cabinet 11, such as used in many supermarkets, and the like. In this respect, a multiplicity of cabinets 11 are generally arranged along an aisle of the supermarket and the doors of adjacent cabinets are in close relation to each other.

As illustrated, the cabinet 11 has a mounting bracket 12 secured in suitable manner near the base of the cabinet 11 with a self-contained door closing mechanism 13 with an integrated door hold-open feature mounted therein.

The door 10 is constructed of an insulated glass unit (IG unit) 14 of rectangular shape and a frame 15 that surrounds the IG unit 14.

The IG unit 14 is constructed of at least a pair of glass panes (or lites) 16 and a perimeter spacer system 17 that functions as a means for maintaining the glass panes 16 in parallel spaced apart relation. The glass panes 16 may use a 5 mm or 6 mm outer glass to provide structural strength to the door 10 and a with 3 mm high-performance low-e glass on the interior to accomplish high energy efficiency while still maintaining sufficient structural strength on the door glass pack.

The use of very-high-performance, dual-glazed low-emissivity glass over clear glass with argon gas fill and warm edge spacer insulating glass system 17 to achieve the highest possible R-values with modern and commercially-viable insulating glass technology allows for the complete elimination of costly (to acquire and operate) electrically-heated insulating glass units in refrigerator applications. Future ultra-high-performance insulating glass technologies (e.g., vacuum insulating glass or "VIG") offer the promise of extending this type of "lean" or "trim" door design to freezer applications and/or extreme environmental conditions without the use of electrically-heated glass to prevent surface condensation on glass.

In situations where electrically heated glass is required the IG unit 14 can be provided with a transparent electrically conductive heating film (not shown) bonded to at least one of the panes and a pair of electrically conductive bus bars (not shown) mounted in electrical contact on the coated pane or panes of glass on opposite sides of the coated pane or panes of glass. A spring clip corner key, such as described in U.S. Ser. No. 12/798,806, filed Apr. 12, 2010, may also be provided to deliver electrical energy to the bus bars.

Similar insulating glass units have been described, for example, in U.S. Pat. Nos. 4,127,765; 4,306,140; 4,691,486 and 5,255,473, and, particularly, in pending patent application Ser. No. 12/798,806, filed Apr. 12, 2010.

Figure 14:
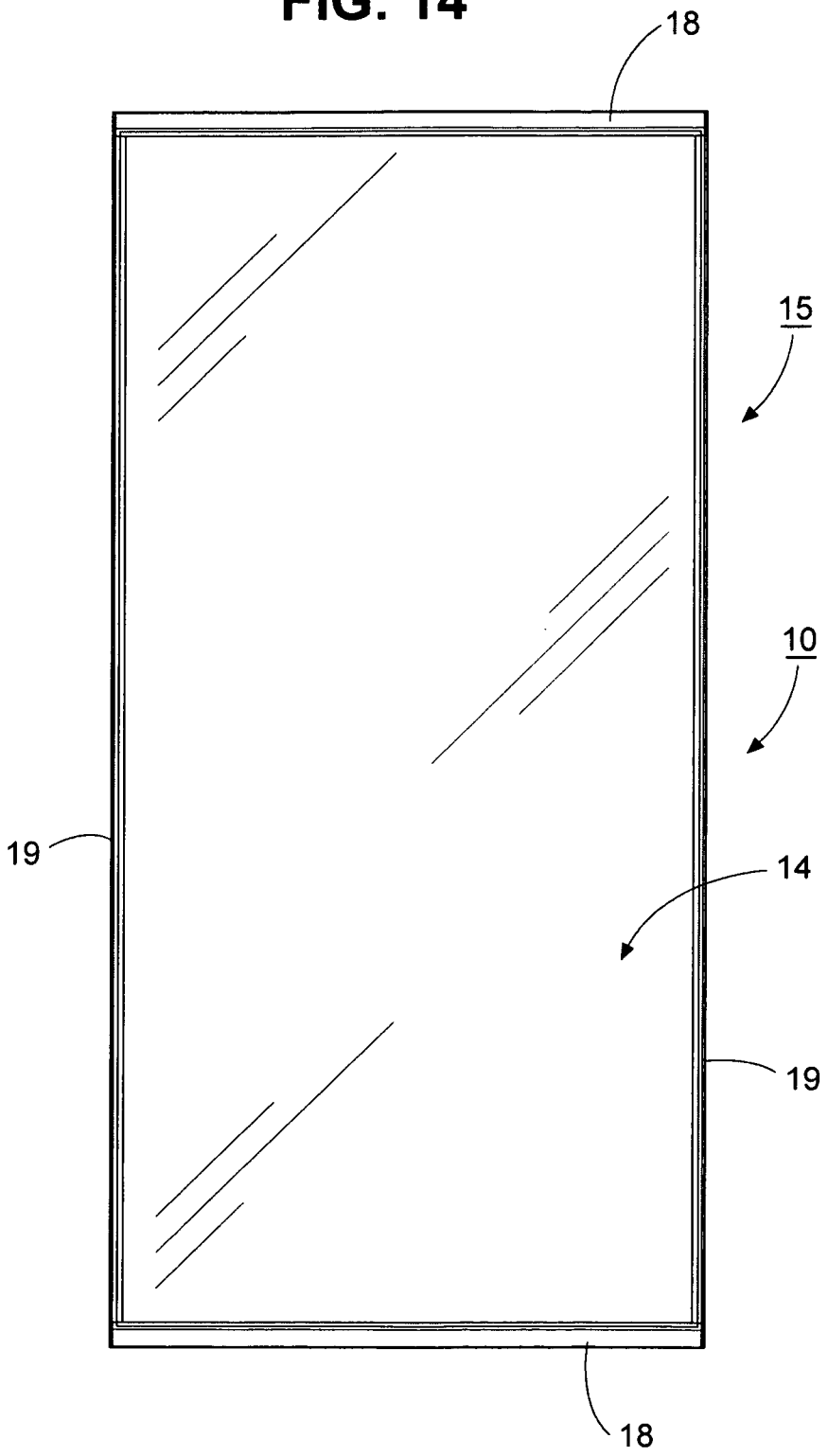
FIG. 14 illustrates a front view of the door of FIG. 1.

Referring to FIG. 14, the rectangular frame 15 is composed of a pair of horizontally disposed aluminum rails 18 and a pair of vertically disposed plastic stiles 19, for example made of polyvinylchloride (PVC). The frame 15 is sized relative to the IG unit 14 to provide an all-glass appearance to the door 10. For example, for a door 10 having overall dimensions of 73.600 inches in height and a width of 30.080 inches, the IG unit 14 has a height of 71.570 inches and a width of 29.844 inches. With the frame 15 receiving the IG unit 14 in a recessed manner on four sides, for example, overlapping each side by 0.475 inches, the clear "window" of the door measures 70.62 inches by 28.894 inches.

Figure 5:
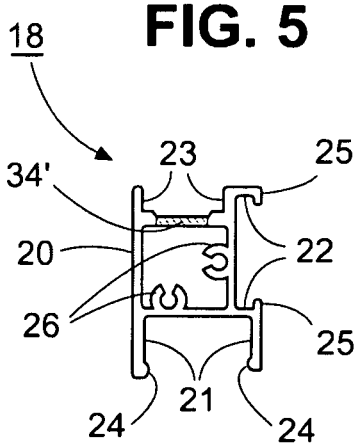
FIG. 5 illustrates a cross-sectional view of a metal rail used to make the frame of the door.

Referring to FIGS. 1 and 5, each aluminum rail 18 is constructed in like manner to be used as the top rail or the bottom rail of the door 10.

As shown in FIG. 5, each rail 18 has four walls permanently connected to each other to define a fully enclosed central hollow box 20; a pair of walls 21 extending outwardly away from an interior of the box 20 to define a channel for receiving the IG unit (not shown); a pair of walls 22 outstanding from the box 20 to define a second channel for receiving a door seal breaker (not shown) and a pair of walls 23 outstanding from the box 20 to define a recess for receiving a hinge plate (not shown). Each wall 21 is also provided with a rounded lip 24 at the end to lie against the IG unit 14 when in place (see FIG. 1). Each wall 22 is also provided with an inturned lip 25 to be engaged by a door seal breaker as explained below.

Each rail 18 also has a pair of integrally formed C-shaped ears 26 within the box 20 for receiving screws (not shown) as explained below.

As shown in FIG. 1, the rails 18 are located at the top and the bottom of the door 10 and each receives the IG unit 14 in recessed manner. To this end, each rail 18 may be separately applied to and centered on the respective end of the IG unit 14 during assembly leaving a small gap at each end of the rail 18 that does not cover the IG unit 14. A suitable sealant may also be applied between each rail 18 and the IG unit 14 to seal any air space therebetween.

Figure 2:
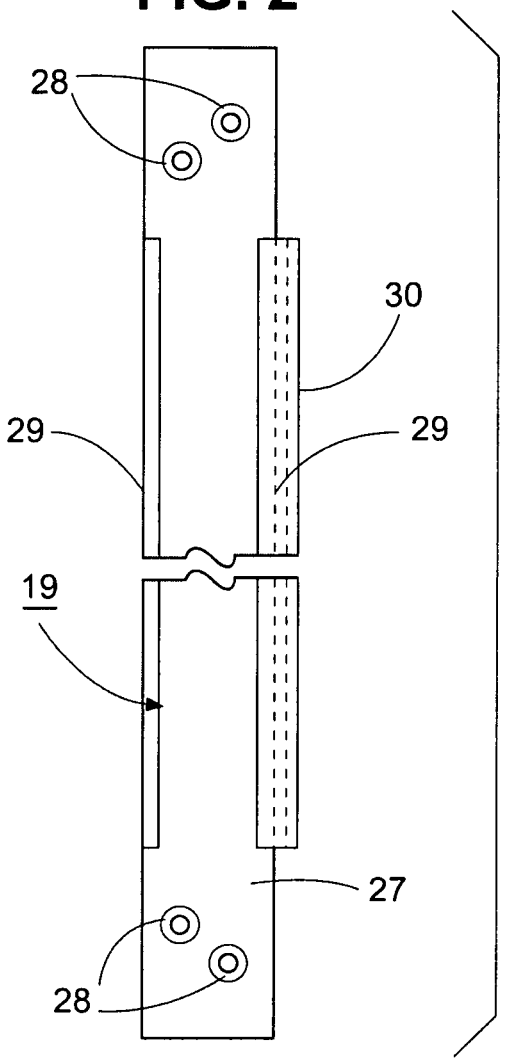
FIG. 2 illustrates a front view of a plastic stile used to make the frame of the door of the invention.
Figure 3:
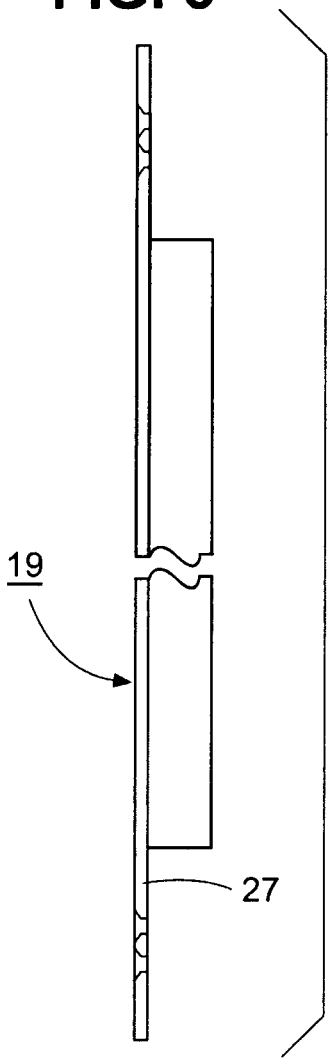
FIG. 3 illustrates a side view of the plastic stile of FIG. 2.
Figure 4:
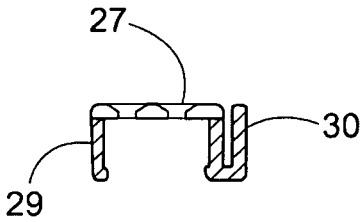
FIG. 4 illustrates a top view of the plastic stile of FIG. 2.

Referring to FIGS. 2 to 4, each stile 19 is sized to be secured to the respective ends of the aluminum rails 18, for example by screws (now shown) in order to close off the gaps between the rails 18 and IG unit 14.

Each stile 19 has a flat body 27 with a pair of recessed bores 28 at each end that are aligned with the C-shaped ears 26 within the box 20 of the rails 18. Suitable screws are used that pass through the bores 28 into the ears 26 to secure the stile 19 to the rails 18.

Each stile 19 also has a pair of walls 29 that define a channel for receiving the IG unit 14 in a recessed manner. These walls 29 are of a length to extend between the rails 18 and to provide a close fit with the rails 18 when in place. In this regard, each stile 19 is separately applied to a respective side of the IG unit 14 during assembly and secured to the rails 18 to form a rectangular frame 15 about the IG unit 14.

The construction of the door 10 is of an extremely easy-to-assemble, highly-modular design, which emphasizes efficient assembly and offers a high degree of flexibility for handling most any size door without the need for complex or expensive tooling to support multiple size doors Referring to FIGS. 3 and 4, each stile 19 also has an L-shaped leg 30 integrally formed on the outside of one of the walls 29.

Referring to FIG. 6, the vertical stile 19 that is at the hinged side of the door 10 receives a foam gasket 31 within the recess defined by the L-shaped leg 30. When the door 10 is closed, the foam gasket 31 seals against the side edge of an adjacent door 10, i.e. against the stile 19 thereof, and seals off the small vertical space between the doors 10. When the door 10 is opened, for example, being pivoted clockwise as viewed in FIG. 6, the foam gasket 31 is rotated away from the adjacent door and into the cabinet (not shown).

Use may be made of a super-high-performance EPDM foam spacer (i.e., warm-edge spacer) for providing best commercially-available edge-of-glass temperatures around the perimeter of the insulating glass unit 14 at the interface between the door structure and the glass.

The vertical stile 19 that is on the handle side of the door 10 may receive a pocket filler 32, for example of rigid PVC, within the recess defined by the L-shaped leg 30 in order to provide a flat surface against which the foam gasket 31 may abut when the adjacent doors 10 are closed.

Referring to FIGS. 7 to 9, a flat elongated hinge plate 33, for example of steel, is provided for mounting in each rail 18 between the walls 23 (see FIG. 9). To this end, the plate 33 is provided with bores 34 that are aligned with corresponding bores 34' (see FIG. 5) in the box 20 of a rail 18 to receive suitable securing means, such as threaded screws (not shown), to secure the hinge plate 33 to the rail 18 in a tight fit manner. Each hinge plate 33 is of a suitable length to accommodate the hinging of the door 10 to the cabinet 11. For example, where the door 10 has a width of about 30 inches, each hinge plate 33 has a length of about 9 inches. The remainder of the channel in the rail 18 that receives the hinge plate 33 may remain empty or may be filled with a suitable filler for aesthetic purposes.

Referring to FIG. 1, the bottom rail 18 of the door 10 is provided with a bore that is aligned with a corresponding bore in the hinge plate 33 that allows an upstanding pivot pin 35 of the self-contained door closing mechanism 13 to pass through thereby pivotally mounting the door 10 on the door closing mechanism 13. This construction allows the door 10 to be lifted off the pin 35, tilted and supported to allow the door closing mechanism 13 to be replaced, if required, without necessarily having to remove the entire door 10. After replacement of the mechanism 13, the door 10 can be placed back on top of the pin 35 without having to completely remove the door 10.

Similarly, the hinge plate 33 in the top rail 18 of the door 10 is articulated via a hinge assembly (not shown) to the cabinet 11 to allow the door to swing outwardly relative to the cabinet 11.

Figure 10:
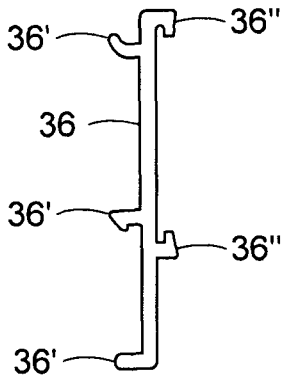
FIG. 10 illustrates a side view of a plastic breaker.
Figure 11:
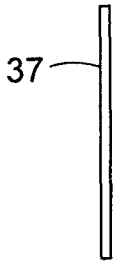
FIG. 11 illustrates a side view of a steel strip.

Referring to FIGS. 1 and 10, each rail 18 has a rigid PVC breaker plate 36 snap fitted via tangs 36' into and over the inturned lips 25 on the walls 22. The breaker plate 36 also has a third tang 36' the extends over a wall 21 of the rail 18 to abut the IG unit Each breaker plate 36 has a pair of outstanding walls 36" that define a channel for receiving a steel strip 37 that provides a flat sealing surface that cooperates with a magnetic seal 38 mounted on the cabinet 11.

Each seal 38 extends across the entire width of the door 10, both at the top and at the bottom, opposite the rails 18 of the IG unit 14. Also, each vertical foam gasket 31 (See FIG. 6) extends to the respective breaker plates 36 on the rails 18 to complete a full perimeter seal about the door 10.

Figure 12:
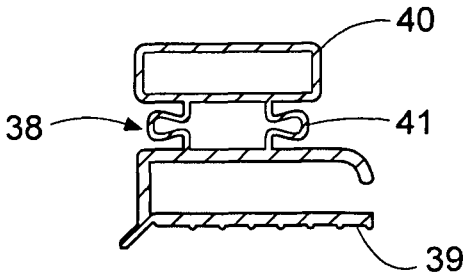
FIG. 12 illustrates a cross-section view of a cabinet seal.
Figure 13:
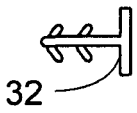
FIG. 13 illustrates a side view of a pocket filler.

Referring to FIG. 12, each seal 38 has a mounting body 39 that is to be secured to the cabinet 11 in a fixed manner, a rubberized magnetic sealing body 40 for engaging against the steel strip 37 on a rail 18 of the door 10 and an integral spring-like resilient section 41 that secures the sealing body 40 to the mounting body 39. When a door 10 is closed, as shown in FIG. 1, the steel strips 37 in the two rails 18 are pulled magnetically against the rubberized magnetic sealing bodies 40 and the resilient sections 41 compress thereby biasing the sealing bodies 40 against the steel strips 37 on the door 10 to form a tight seal.

As illustrated in FIG. 1, each seal 38 is mounted on a bracket 42 of suitable size and shape on the face of the cabinet 11 via the mounting body 39.

The door 10 also has a handle (not shown) mounted thereon in conventional manner. For example, the handle may be secured on the IG unit 14.

The invention thus provides a door that eliminates any need for a separate frame and mullion system/structure for mounting and gasketing the door to the face of a reach-in refrigerator cabinet. Further, the invention eliminates the need for extensive assembly labor at a refrigerator manufacturer's location associated with uncrating, inspecting, leveling, installing and wiring separate door framing system. Still further, the invention eliminates the substantial freight investment associated with shipping bulky, low-weight, low-density door frame systems that are separate from the doors.

The door allows the use of extremely narrow mullions in refrigerated cabinets by removing mullions from a traditional full-perimeter framing system, with the ability to make the mullions as small as the smallest diameter (or width) possible for end-customer-driven mullion-installed lighting or shelving options (e.g., LED or Fluorescent lighting, shelving brackets, label holders, etc.)

Mullions can be "minimized" in width, thus greatly increasing the usable product display space (interior cubic feet) and consumer-viewable cabinet area. Mullions can quite literally be as small as the smallest component that is required to be installed on a mullion (e.g., lighting, shelf brackets, signage, supports, etc.). In theory, mullions could be eliminated altogether in certain applications where interior lighting and/or cabinet or shelving support can be achieved without a vertical support in between each door. This would allow for a "truly all-glass door" to be achieved.

The door substantially reduces the "blocked view" at the edges of the doors and "between" the doors from a typical 3.0"-to-5.0" width for traditional cabinets to 1.25" or less for the new design, or a minimum of a 50% improvement in visible glass width at each mullion or door-to-door or door-to-cabinet wall "joint".

The door/cabinet-based gasketing approach of the invention reduces air leakage and assists in accomplishing the complete elimination of the traditional perimeter framing system that gaskets the cabinet. The advantages obtained by this approach include sealing the vertical edges of each door to the vertical edges of each adjacent door, and then to the vertical ends (side walls) of the cabinet, sealing the horizontal door surfaces to the cabinet utilizing a single, non-seamed, non-mitered, full-width, non-welded, linear magnetic bulb seal across the full-width of the top and bottom of the refrigerator cabinet and joining" the vertical gasket to the horizontal gasket using a simple butt-cut intersection, with room provided for the addition of a simple "chimney block" component, should there be any air leak in the joint.

What is claimed is:

1. A door for a refrigerated cabinet comprising an insulated glass unit of rectangular shape, said unit having at least a pair of glass panes and a perimeter spacer system maintaining said glass panes in parallel spaced apart relation; and a frame surrounding said insulated glass unit, said frame including a pair of horizontally disposed aluminum rails and a pair of vertically disposed plastic stiles, each said stile being secured at each end thereof to a respective end of each of said rails;

each said rail having four walls permanently connected to each other to define a fully enclosed central hollow box and a first pair of walls extending outwardly away from an interior of said box to define a first channel receiving said insulated glass unit in a recessed manner;

each said stile having a flat body and a pair of walls extending from said flat body to define a channel receiving said insulated glass unit in a recessed manner; and a door closing mechanism hingedly mounting said frame thereon for movement between a closed position relative to a cabinet and an open position relative to the cabinet and a foam gasket mounted on at least one of said stiles for sealing against a stile of an adjacent door in said closed position of said frame and for projecting into the cabinet in said open position of said frame.

2. A door as set forth in claim 1 wherein each said stile has an L-shaped leg integrally formed on an exterior of one of said walls thereof and defining a recess and a foam gasket within said recess of one stile of said pair of stiles for sealing against a stile of an adjacent door.

3. A door as set forth in claim 1 wherein each said rail has a second pair of walls extending from said box to define a second channel and an inturned lip on each said wall of said second pair of walls and which further comprises a pair of breaker plates, each said breaker plate being snap fitted into said second channel of a respective rail and over said inturned lips thereof.

4. A door as set forth in claim 3 wherein each said breaker plate has a channel and which further comprises a pair of steel strips, each said steel strip being received in said channel of a respective breaker plate.

5. A door as set forth in claim 1 wherein said insulated glass unit further comprises a transparent electrically conductive heating film bonded to at least one of said panes and a pair of electrically conductive bus bars mounted in electrical contact on said heating film on opposite sides of said pane.

6. A door for a refrigerated cabinet comprising an insulated glass unit of rectangular shape, said unit having at least a pair of glass panes and a perimeter spacer system maintaining said glass panes in parallel spaced apart relation; and a frame surrounding said insulated glass unit, said frame including a pair of horizontally disposed aluminum rails and a pair of vertically disposed plastic stiles, each said stile being secured at each end thereof to a respective end of each of said rails;

each said rail having four walls defining a fully enclosed central hollow box and a first pair of walls extending outwardly away from an interior of said box to define a first channel receiving said insulated glass unit in a recessed manner;

each said stile having a pair of walls defining a channel receiving said insulated glass unit in a recessed manner; and wherein each said rail has a pair of integrally formed C-shaped ears within said box and at each end thereof, each said stile has a pair of recessed bores at each end thereof aligned with a respective pair of C-shaped ears of a respective rail and a plurality of screws passing through said bores of said stiles and into said C-shaped ears of said rails to secure said stiles to said rails.

7. In combination a refrigerated cabinet;

a plurality of doors mounted on said cabinet in side-by-side relation for movement between a closed position relative to said cabinet and an open position relative to said cabinet, each said door having an insulated glass unit of rectangular shape, said unit having at least a pair of glass panes and a perimeter spacer system maintaining said glass panes in parallel spaced apart relation; and a frame surrounding said insulated glass unit, said frame including a pair of horizontally disposed aluminum rails and a pair of vertically disposed plastic stiles, each said stile being secured at each end thereof to a respective end of each of said rails;

each said rail having four walls permanently connected to each other to define a fully enclosed central hollow box and a first pair of walls extending outwardly away from an interior of said box to define a first channel receiving said insulated glass unit in a recessed manner;

each said stile having a flat body and a pair of walls extending from said flat body to define a channel receiving said insulated glass unit in a recessed manner; and a foam gasket mounted on at least one of said stiles of each respective door for sealing against a stile of an adjacent door of said plurality of doors in said closed position thereof and for projecting into said cabinet in said open position thereof.

8. The combination as set forth in claim 7 further comprising a pair of horizontally disposed seals secured to said cabinet opposite each said door, each said horizontally disposed seal being in sealing contact with a respective rail of said pair of rails of each said door in said closed position thereof.

9. The combination as set forth in claim 7 wherein each said stile of each said door has an L-shaped leg integrally formed on an exterior thereof and defining a recess and a foam gasket within said recess for sealing against a respective stile of an adjacent door of said plurality of doors.

* * * * *